US011808101B2

(12) United States Patent
Urrutia et al.

(10) Patent No.: US 11,808,101 B2
(45) **Date of Patent: *Nov. 7, 2023**

(54) SHEAR RAM FOR A BLOWOUT PREVENTER

(71) Applicant: SCHLUMBERGER TECHNOLOGY CORPORATION, Sugar Land, TX (US)

(72) Inventors: Miguel Urrutia, Rosharon, TX (US); Micah Threadgill, Cypress, TX (US); John Gregory Landthrip, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/811,179

(22) Filed: Jul. 7, 2022

(65) Prior Publication Data

US 2022/0341277 A1 Oct. 27, 2022

Related U.S. Application Data

(63) Continuation of application No. 16/891,675, filed on Jun. 3, 2020, now Pat. No. 11,391,108.

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063; E21B 33/064
USPC ..... 137/1.1, 1.2, 1.3
See application file for complete search history.

(56) References Cited

U.S. PATENT DOCUMENTS

| | | | |
|---|---|---|---|
| 2,749,078 | A | 6/1956 | Losey |
| 3,946,806 | A | 3/1976 | Meynier, III |
| 4,313,496 | A | 2/1982 | Childs et al. |
| 4,537,250 | A | 8/1985 | Troxell, Jr. |
| 5,515,916 | A | 5/1996 | Haley |
| 7,367,396 | B2 | 5/2008 | Springett et al. |

(Continued)

FOREIGN PATENT DOCUMENTS

| | | | |
|---|---|---|---|
| FR | 3105041 | A1 | 6/2021 |
| WO | 2020169714 | A1 | 8/2020 |

(Continued)

*Primary Examiner* — Kevin F Murphy
*Assistant Examiner* — Jonathan J Waddy
(74) *Attorney, Agent, or Firm* — Kelly McKinney

(57) ABSTRACT

The present disclosure relates to a ram system for a blowout preventer. The ram system includes a first ram having an interlocking arm, where the interlocking arm includes a first anti-deflection feature. The ram system includes a second ram having a second anti-deflection feature. The first ram and the second ram are configured to move toward one another along a longitudinal axis to reach an engaged configuration. The second ram is configured to receive the interlocking arm of the first ram to enable the first anti-deflection feature to engage with the second anti-deflection feature while the first ram and the second ram are in the engaged configuration to thereby enable the first and second anti-deflection features to block deflection of the interlocking arm relative to a lateral axis, an axial axis, or both.

16 Claims, 11 Drawing Sheets

(56) References Cited

U.S. PATENT DOCUMENTS

| | | | |
|---|---|---|---|
| 7,814,979 | B2 | 10/2010 | Springett et al. |
| 8,066,070 | B2 | 11/2011 | Springett et al. |
| 8,162,046 | B2 | 4/2012 | Jahnke |
| 8,167,031 | B2 | 5/2012 | Jahnke |
| 8,353,338 | B2 | 1/2013 | Edwards |
| 8,424,607 | B2 | 4/2013 | Springett et al. |
| 8,443,879 | B2 | 5/2013 | Jahnke |
| 8,443,880 | B1 | 5/2013 | Jahnke |
| 8,464,785 | B2 | 6/2013 | Carbaugh et al. |
| 8,505,870 | B2 | 8/2013 | Yadav et al. |
| 8,567,490 | B2 | 10/2013 | Van Winkle |
| 8,602,102 | B2 | 12/2013 | Springett et al. |
| 8,720,564 | B2 | 5/2014 | Springett et al. |
| 8,720,565 | B2 | 5/2014 | Springett et al. |
| 8,720,567 | B2 | 5/2014 | Springett et al. |
| 8,770,274 | B2 | 7/2014 | Van Winkle |
| 8,800,954 | B2 | 8/2014 | Edwards |
| 8,807,219 | B2 | 8/2014 | Springett et al. |
| 9,022,104 | B2 | 5/2015 | Springett et al. |
| 9,133,680 | B2 | 9/2015 | Edwards |
| 9,644,444 | B2 | 5/2017 | Jurena |
| 9,732,576 | B2 | 8/2017 | Rao et al. |
| 9,739,109 | B2 | 8/2017 | Kroesen |
| 9,822,602 | B2 | 11/2017 | Bleck et al. |
| 9,879,498 | B2 | 1/2018 | Holland, Jr. |
| 10,233,716 | B2 | 3/2019 | van Wijk et al. |
| 10,443,336 | B2 | 10/2019 | Ellison |
| 11,391,108 | B2 * | 7/2022 | Urrutia ..... E21B 33/063 |
| 2008/0001107 | A1 | 1/2008 | Gass et al. |
| 2012/0318493 | A1 | 12/2012 | Carbaugh et al. |
| 2013/0062540 | A1 | 3/2013 | Jurena |
| 2013/0168075 | A1 | 7/2013 | Shah et al. |
| 2016/0258238 | A1 | 9/2016 | Vargas et al. |
| 2016/0298409 | A1 | 10/2016 | Kroesen et al. |
| 2017/0058628 | A1 | 3/2017 | van Wijk et al. |
| 2017/0362911 | A1 | 12/2017 | Read et al. |
| 2020/0332617 | A1 | 10/2020 | Nault et al. |
| 2021/0381333 | A1 | 12/2021 | Urrutia et al. |

FOREIGN PATENT DOCUMENTS

| | | | |
|---|---|---|---|
| WO | 2020219410 | A1 | 10/2020 |
| WO | 2020219412 | A1 | 10/2020 |

* cited by examiner

SHEAR RAM FOR A BLOWOUT PREVENTER

This application claims priority as a continuation application of U.S. patent application Ser. No. 16/891,675, titled "SHEAR RAM FOR A BLOWOUT PREVENTER," filed Jun. 3, 2020. The priority application is incorporated by reference herein in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack may be installed on a wellhead to seal and control a well during drilling, well-logging, and/or other operations performed on a geological formation. For example, during drilling operations, a drill string may be suspended inside a drilling riser and extend through the BOP stack into the wellhead. The drill string may include equipment, such as a drilling bit, which enables removal of material from the geological formation to facilitate formation of a wellbore. Alternatively, during well-logging operations, a cable (e.g., a wireline cable) may extend through the drilling riser and the BOP stack and may couple to a downhole tool disposed within the wellbore. The downhole tool may include measurement tools and/or sensors for measuring characteristics of a fluid within the wellbore and/or characteristics of the geological formation. In the event of a rapid invasion or formation of fluid in the wellbore, commonly known as a "kick," the BOP stack may be actuated to isolate the drilling riser from the wellhead to protect well equipment disposed above the BOP stack.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
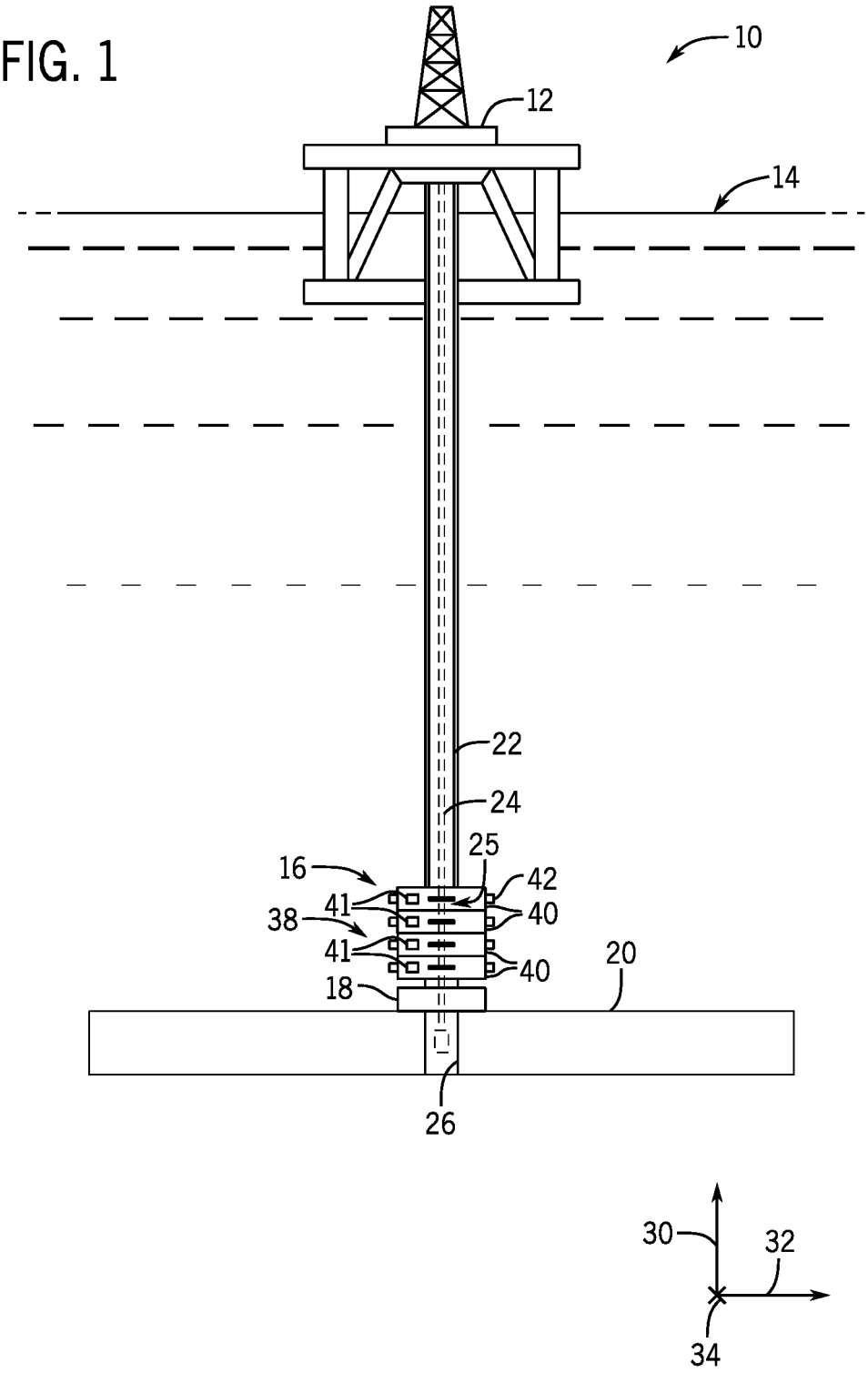
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components. Numerical terms, such as "first," "second," and "third" are used to distinguish components to facilitate discussion, and it should be noted that the numerical terms may be used differently or assigned to different elements in the claims.

A blowout preventer (BOP) system may be included at a wellhead to block a fluid from inadvertently flowing from the wellhead to a drilling platform (e.g., through a drilling riser). For example, pressures may fluctuate within a natural fluid reservoir (e.g., an oil and/or natural gas reservoir), which may lead to a surge in fluid flow from the wellhead toward the drilling platform when the pressure reaches a threshold value. To block fluid from flowing toward the drilling platform during a kick and/or a blowout condition, the BOP system may be actuated to cover or seal a bore in the BOP system that fluidly couples the wellhead to the drilling riser. In some cases, rams (e.g., shear rams) of the BOP system are actuated to engage (e.g., contact and/or cut) a tubular (e.g., drill string, wireline, cable) disposed in the bore to facilitate sealing of the bore (e.g. blocking fluid flow through the bore).

For example, the BOP system generally includes one or more sets of rams that each include an upper ram (e.g., a first ram) and a lower ram (e.g., a second ram). During a blowout condition, the upper ram and the lower ram of a particular set of rams move toward one another to engage the tubular positioned within the bore. The upper and lower rams include respective cutting edges or blades that enable the rams to sever (e.g., cut, shear) the tubular extending through the BOP system and to fully constrict or seal the bore. In this manner, the BOP system is operable to substantially block fluid flow through the bore and toward other wellbore equipment disposed upstream of the BOP system.

Embodiments of the present disclosure are directed toward an improved BOP system configured to reduce or substantially inhibit separation of the rams from one another during performance of shearing operations. In the improved BOP system, the upper ram, the lower ram, or both, may include one or more interlocking arms that are configured to keep blades (e.g., cutting edges) of the rams adjacent to one another during the shearing operations. For example, the interlocking arms may block the upper and lower rams from diverging (e.g., along a central axis of the bore) when the rams are compressed against the tubular. As such, the interlocking arms may ensure that the rams are able to adequately cut or sever the tubular within the bore.

Additionally, in the improved BOP system, the rams have deflection mitigation features or anti-deflection features that are configured to block deflection of the interlocking arms beyond an acceptable range (e.g., a threshold range) or to substantially inhibit deflection of the interlocking arms. Thus, the features may block the interlocking arms, as well as the upper ram and the lower ram, from diverging from one another (e.g., along a central axis of the bore) and from deviating from desired positions during the shearing operations. Accordingly, the features may increase an effectiveness of the shearing and sealing by the rams. It is also recognized that spatial constraints within a housing of the BOP system may make it preferable to minimize enlargement of the interlocking arms, and thus, the features are configured to provide the disclosed advantages while also minimizing the enlargement of the interlocking arms.

In some embodiments, the upper ram includes the interlocking arms and the lower ram includes a body portion configured to engage with the interlocking arms (e.g., when the upper ram is moved toward the lower ram during shearing operations performed on the tubular). The interlocking arms may include a first set of deflection mitigation features (e.g., protrusions) that extend laterally from the interlocking arms. The body portion of the lower ram may include a second set of deflection mitigation features (e.g., grooves) that are configured to receive the first set of deflection mitigation features when the upper and lower rams converge. The first and seconds sets of deflection mitigation features may form a key-slot interface and are configured to engage or physically contact one another (e.g., upon application of a threshold load on the interlocking arms) to block or substantially block deformation of the interlocking arms during operation of the BOP system. To this end, the first and second sets of deflection mitigation features enable the interlocking arms to retain the blades of the upper and lower rams at target positions during shearing operations performed on the tubular. As such, the deflection mitigation features may increase an operational reliability of the rams by ensuring that the rams can effectively sever a large-diameter tubular disposed within the bore. These and other features will be described below with reference to the drawings.

With the foregoing in mind, FIG. 1 is a schematic of an embodiment of a drilling system 10. The drilling system 10 includes a vessel or platform 12 located at a surface 14. A BOP stack assembly 16 is mounted to a wellhead 18 at a floor 20 (e.g., a sea floor for offshore operations). A riser 22 extends from the platform 12 to the BOP stack assembly 16. The riser 22 may return drilling fluid or mud to the platform 12 during drilling operations. Downhole operations are carried out by a tubular 24 (e.g., drill string, wireline, cable) that extends from the platform 12, through the riser 22, through a bore 25 of the BOP stack assembly 16, and into a wellbore 26.

Although the drilling system 10 is shown as an offshore system in the illustrated embodiment of FIG. 1, it should be appreciated that, in other embodiments, the drilling system 10 may include a land-based drilling system or another other suitable stationary or mobile drilling system. Moreover, it should be understood that the drilling system 10 may also be used to convey a downhole well-logging tool into the wellbore 26 via a cable (e.g., a wireline cable) that is spooled or unspooled on a drum of the drilling system 10, and the tubular 24 referenced herein is intended to represent any of a wide variety of components, including the cable, that may extend through the bore 25 of the BOP stack assembly 16. As an example, the drilling system 10 may utilize the well-logging tool to acquire sensor feedback indicative of parameters of a fluid within the wellbore 26 and/or of the geological formation surrounding the wellbore 26.

To facilitate discussion of the BOP stack assembly 16 and its components, the BOP stack assembly 16 may be described with reference to an axial axis 30 (e.g., extending generally along the tubular 24), a longitudinal axis 32, and a lateral axis 34. The longitudinal axis 32 and the lateral axis 34 extend radially from (e.g., crosswise to) the axial axis 30. For clarity, relative terms, such as, for example, longitudinal, lateral, upper, and lower are used throughout the following discussion to describe relative positions of various components or regions of the BOP stack assembly 16 with respect to other components or regions of the BOP stack assembly 16, and are not intended to denote a particular direction or spatial orientation. As such, it should be understood that such relative terms are intended to facilitate discussion and are dependent upon an orientation of an observer with respect to the BOP stack assembly 16 and its components.

In the illustrated embodiment, the BOP stack assembly 16 includes a BOP stack 38 having multiple BOPs 40 (e.g., ram BOPs) axially stacked (e.g., along the axial axis 30) relative to one another. As discussed in more detail below, each BOP 40 may include a pair of longitudinally opposed rams and corresponding actuators 42 that actuate and drive the rams toward and away from one another along the longitudinal axis 32. Although four BOPs 40 are shown in the illustrated embodiment of FIG. 1, the BOP stack 38 may include any suitable number of the BOPs 40 (e.g., 1, 2, 3, 4, 5, 6 or more than 6 BOPs 40).

Additionally, the BOP stack 38 may include any of a variety of different types of rams. For example, in certain embodiments, the BOP stack 38 may include one or more BOPs 40 having opposed shear rams or blades configured to sever the tubular 24 and seal off the wellbore 26 from the riser 22. Additionally or alternatively, the BOP stack 38 may include one or more BOPs 40 having opposed pipe rams configured to engage the tubular 24 and to seal the bore 25 (e.g., to seal an annulus around the tubular 24) without severing the tubular 24. In any case, certain of the BOPs 40 may include rams having interlocking arms that facilitate guiding the rams toward one another when the BOPs 40 are transitioned from respective open positions to respective closed or sealed positions (e.g., in which the bore 25 is substantially blocked or sealed). As discussed in detail below, the rams may include deflection mitigation features or anti-deflection features 41 that are configured to mitigate or substantially inhibit deflection of the interlocking arms due to compressive or tensile loads that may be imposed on the interlocking arms during operation of the BOP stack assembly 16.

Figure 2:
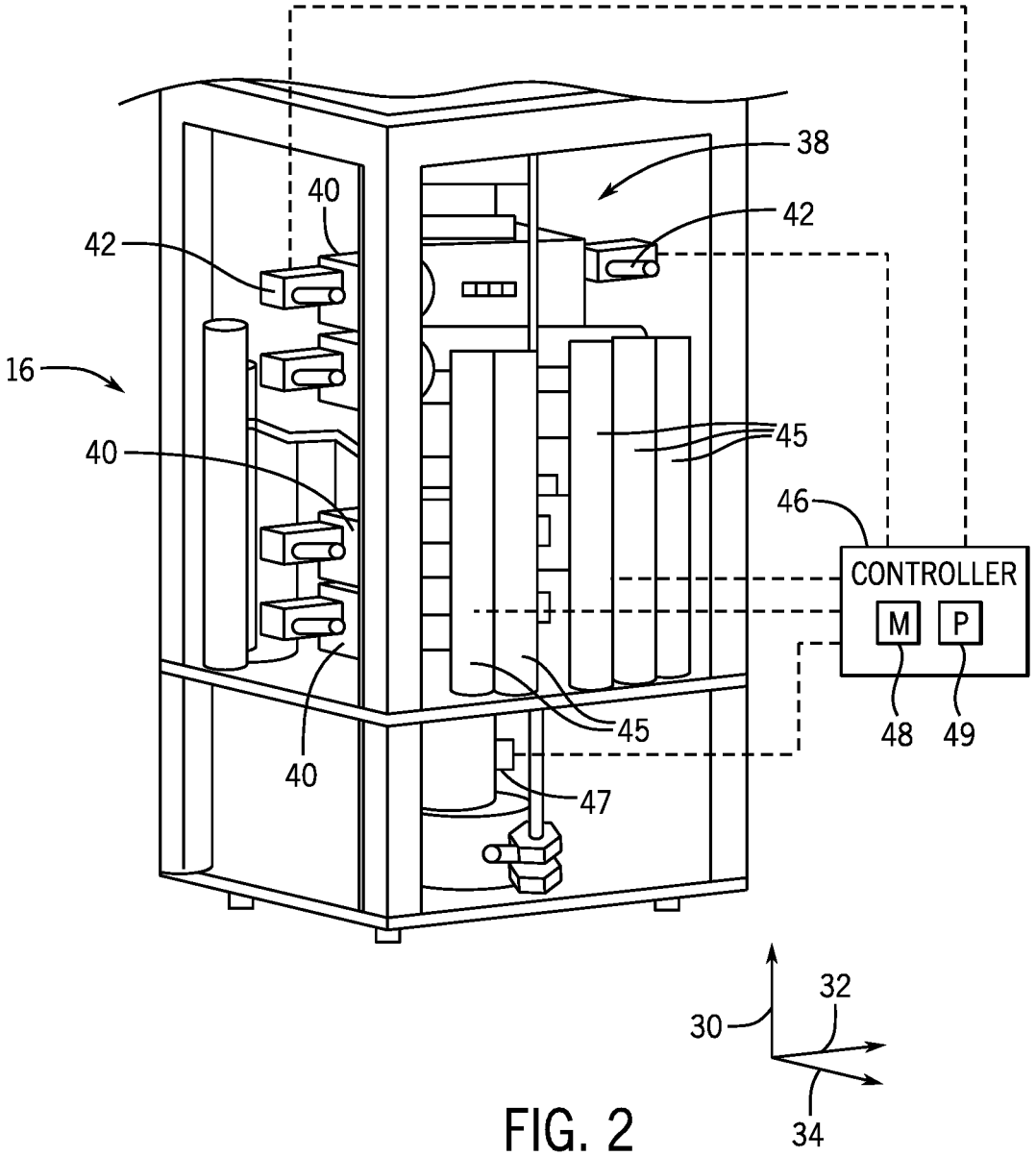
FIG. 2 is a perspective view of a blowout preventer (BOP) stack assembly that may be used in the drilling system of FIG. 1, in accordance with an embodiment of the present disclosure.

FIG. 2 is a perspective view of an embodiment of the BOP stack assembly 16. As discussed above, the BOP stack 38 includes multiple BOPs 40 axially stacked (e.g., along the axial axis 30) relative to one another. In some embodiments, the BOP stack 38 includes one or more accumulators 45 (e.g., hydraulic accumulators) that are coupled to a frame or support structure of the BOP stack 38. The accumulators 45 may store and/or supply (e.g., via one or more pumps) hydraulic pressure to the actuators 42, which are configured to drive movement of the rams of the BOPs 40. In certain embodiments, the accumulators 45 and/or the actuators 42 may be communicatively coupled to a controller 46. The controller 46 may be configured to send signals to the accumulators 45, the actuators 42, and/or one or more pumps to drive the rams of the BOPs 40 when blowout conditions exist. For example, the controller 46 may receive feedback from one or more sensors 47 (e.g., pressure sensors, temperature sensors, flow sensors, vibration sensors, and/or composition sensors) that may monitor conditions of the wellbore 26 (e.g., a pressure of the fluid in the wellbore 26). The controller 46 may include a memory 48 that stores threshold values indicative of blowout conditions. Accordingly, a processor 49 of the controller 46 may send a signal instructing the accumulators 45, the actuators 42, and/or the one or more pumps to drive and/or actuate the rams to closed positions when measured feedback received from the controller 46 meets or exceeds such threshold values.

Figure 3:
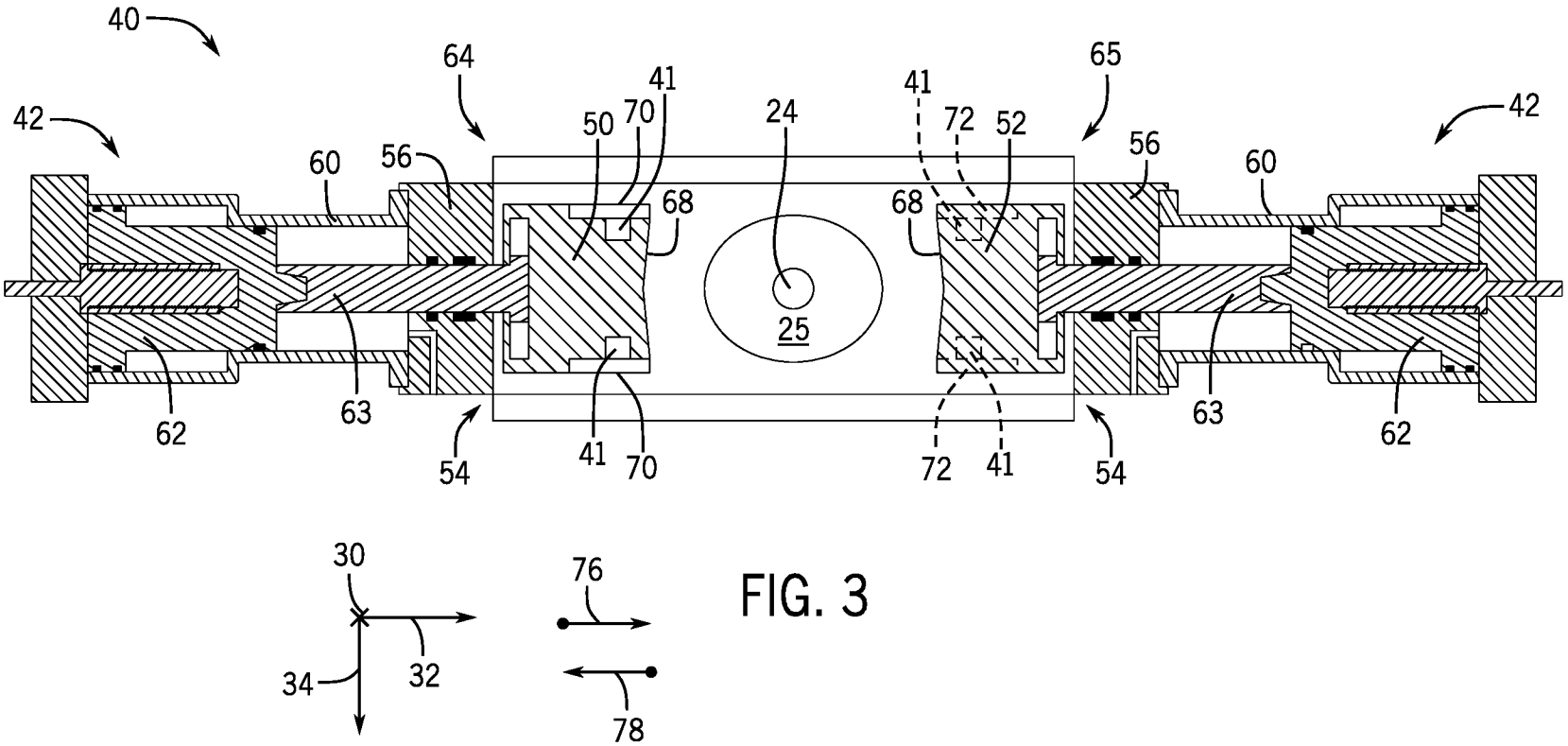
FIG. 3 is a cross-sectional top view of a portion of a BOP that may be used in the BOP stack assembly of FIG. 2, wherein a first ram and a second ram of the BOP are in open positions, in accordance with an embodiment of the present disclosure.

FIG. 3 is a cross-sectional top view of a portion of one of the BOPs 40. The BOP 40 includes a first ram 50 (e.g., an upper ram) and a second ram 52 (e.g., a lower ram) that, in the illustrated embodiment, are positioned in respective open or default positions 54. The first ram 50 and the second ram 52 may be collectively referred to herein as a ram system of the BOP 40. In the default positions 54, the first ram 50 and the second ram 52 are withdrawn or retracted from the bore 25, do not contact the tubular 24, and/or do not contact the corresponding opposing ram 50, 52. As shown, the BOP 40 includes a housing 56 (e.g., casing) surrounding the bore 25. The housing 56 is generally rectangular in the illustrated embodiment, although the housing 56 may have any cross-sectional shape, including any polygonal shape or an annular shape. A plurality of bonnet assemblies 60 are mounted to the housing 56 (e.g., via threaded fasteners). In the illustrated embodiment, first and second bonnet assemblies 60 are mounted to diametrically opposite sides of the housing 56. Each bonnet assembly 60 supports an actuator 42, which may include a piston 62 and a connecting rod 63.

As shown in the illustrated embodiment of FIG. 3, when in the default position 54, the first ram 50 is generally adjacent to a first end 64 of the housing 56 and the second ram 52 is generally adjacent to a second end 65, opposite the first end 64, of the housing 56. The actuators 42 may drive the first and second rams 50, 52 toward and away from one another along the longitudinal axis 32 and through the bore 25 to contact and/or shear the tubular 24 to seal the bore 25. The first ram 50 and/or the second ram 52 may include a blade 68 that enables the rams 50, 52 to more effectively cut or sever the tubular 24. While the illustrated embodiment of FIG. 3 shows the first and second rams 50, 52 as shearing rams, embodiments of the present disclosure may be applied to any suitable type of ram (e.g., pipe ram).

In some embodiments, the first ram 50 includes a set of interlocking arms 70, and the second ram 52 includes corresponding receiving features 72. The receiving features 72 are configured to engage with the interlocking arms 70 when the rams 50, 52 move (e.g., along the longitudinal axis 32) toward respective closed positions in which the bore 25 is constricted or sealed. For example, the interlocking arms 70 of the first ram 50 may engage with the receiving features 72 of the second ram 52 after the first ram 50 moves from its respective default position 54 by a first threshold distance (e.g., in a first direction 76, along the longitudinal axis 32) and the second ram 52 moves from its respective default position 54 by a second threshold distance (e.g., in a second direction 78, opposite the first direction 76, along the longitudinal axis 32). The engagement between the interlocking arms 70 and the receiving features 72 may guide movement of the first and second rams 50, 52 along the longitudinal axis 32, particularly while the rams 50, 52 shear through the tubular 24 that may be positioned within the bore 25.

In certain cases, the interlocking arms 70 may bend and/or plastically deform during shearing operations performed by the rams 50, 52, such as when the tubular 24 positioned within the bore 25 is relatively large. For example, shearing loads (e.g., compressive and/or tensile forces) imposed on the rams 50, 52 when the rams 50, 52 are forced (e.g., via the pistons 62) toward respective closed positions to sever the tubular 24 may be sufficiently large to induce deformation of the interlocking arms 70. Moreover, as discussed below, compression of seals within the housing 56 may impose additional loads on the interlocking arms 70 that may result in deformation of the interlocking arms 70.

Without the deflection mitigation features 41, such deformation of the interlocking arms 70 may permit the rams 50, 52 and the corresponding blades 68 to diverge from desired positions during shearing of the tubular 24 and, thus, reduce a shearing effectiveness of the blades 68. In particular, without the deflection mitigation features 41, such deformation of the interlocking arms 70 may enable the rams 50, 52 to diverge from one another with respect to the axial axis 30 (e.g., when being driven by the pistons 62), which may reduce a shearing effectiveness of the blades 68. Accordingly, embodiments of the first and seconds rams 50, 52 discussed herein are equipped with the deflection mitigation features 41 that inhibit or substantially block bending or deformation of the interlocking arms 70. Accordingly, the deflection mitigation features 41 ensure that an overall shearing effectives of the BOP 40 is not compromised when severing the tubular 24 during operation.

Figure 4:
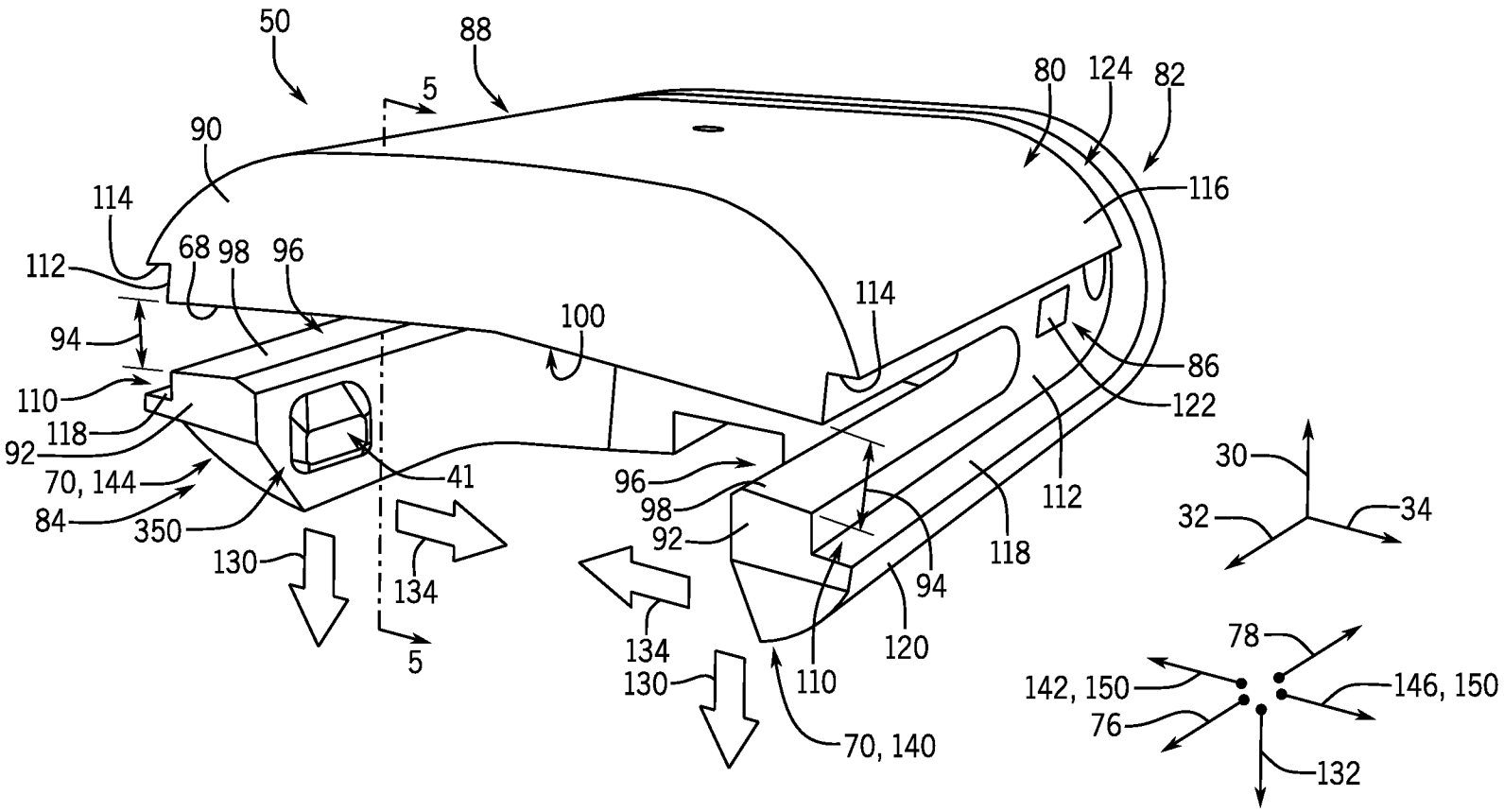
FIG. 4 is a perspective view of the first ram that may be included in the BOP of FIG. 3, in accordance with an embodiment of the present disclosure.

To better illustrate one of the deflection mitigation features 41 of the first ram 50 and to facilitate the following discussion, FIG. 4 is a perspective view of an embodiment of the first ram 50. As shown in the illustrated embodiment, the first ram 50 includes a first body portion 80 that extends along the longitudinal axis 32 from a first end portion 82 of the first body portion 80 to a second end portion 84 of the first body portion 80. The first end portion 82 of the first body portion 80 includes a base section 86 that may be configured to couple to the corresponding connecting rod 63 of the first ram 50 via fasteners, an interference fit, or another suitable connection or coupler.

An upper blade section 88 and the interlocking arms 70 protrude from the base section 86 (e.g., in the first direction 76) and extend generally along the longitudinal axis 32. As such, an end face 90 of the upper blade section 88 and respective end faces 92 of interlocking arms 70 may collectively form the second end portion 84 of the first ram 50. In some embodiments, the upper blade section 88 and the interlocking arms 70 may be formed integrally with the first body portion 80. In other embodiments, at least a portion of the upper blade section 88 and/or portions of the interlocking arms 70 may include separate components that are coupled to the first body portion 80 (e.g., to the base section 86) via suitable fasteners, an interference fit, or a metallurgical process, such as welding or brazing.

Figure 8:
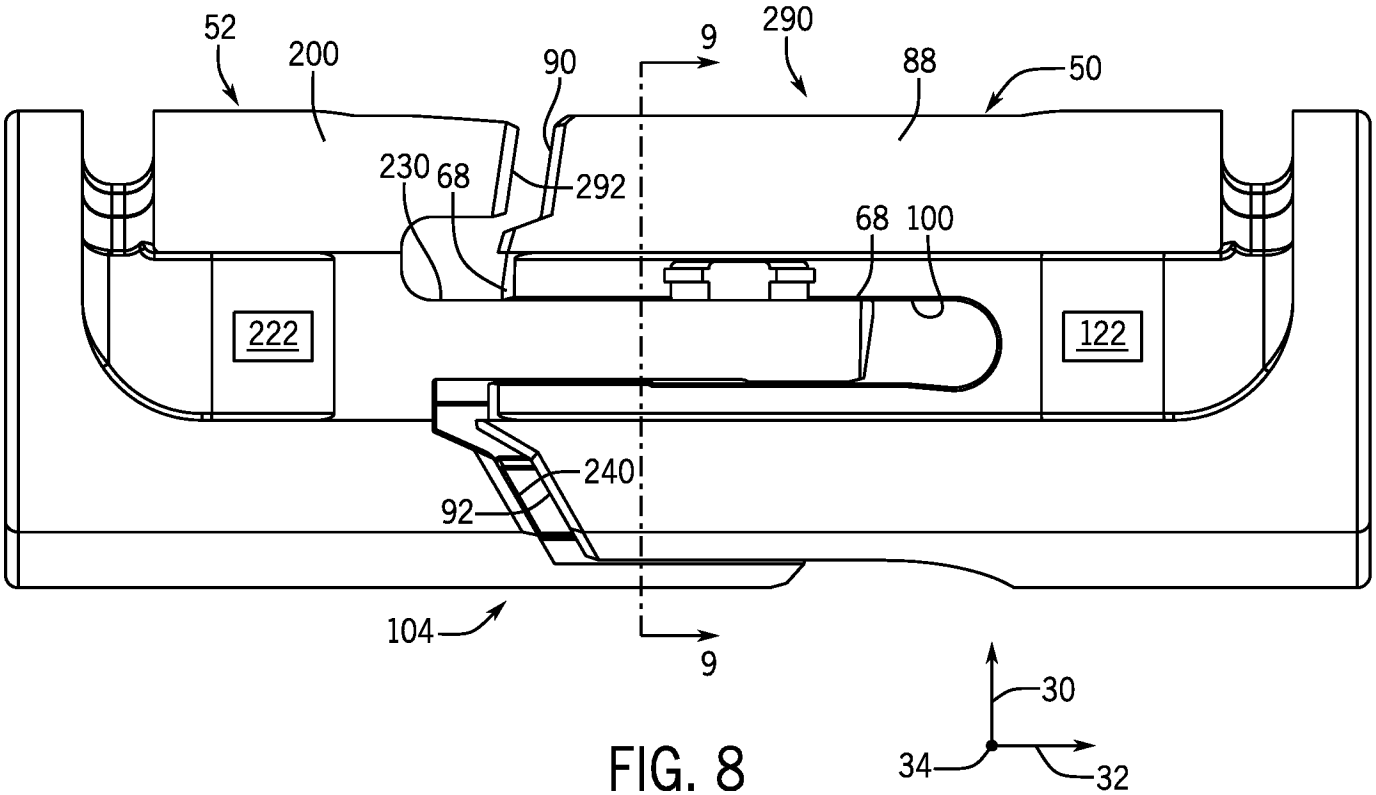
FIG. 8 is a side view of the first ram and the second ram that may be used in the BOP of FIG. 3, wherein the first ram and the second ram are in an engaged configuration, in accordance with an embodiment of the present disclosure.

The upper blade section 88 includes the blade 68 of the first ram 50. As discussed above, the blade 68 enables the first ram 50 to shear through the tubular 24 that may be positioned within the bore 25. As shown in the illustrated embodiment, the interlocking arms 70 are axially spaced apart (e.g., along the axial axis 30) from the upper blade section 88 by respective gaps 94. As such, the interlocking arms 70 may form interlocking channels 96 that extend between upper surfaces 98 of the interlocking arms 70 and a lower surface 100 (e.g., see also FIG. 5) of the upper blade section 88. As discussed below, the interlocking channels 96 are configured to engage with respective interlocking tabs 102 (as shown in FIG. 6) of the second ram 52 during operation of the BOP 40. In this manner, the interlocking arms 70 may guide movement of the first and second rams 50, 52 toward one another when the rams 50, 52 are transitioned from the default positions 54 to respective closed positions 104 (e.g., as shown in FIG. 8) in the BOP 40. It should be understood that axial dimensions of the gaps 94 (e.g., dimensions extending along the axial axis 30) may be substantially constant along at least a portion of the interlocking channels 96 (e.g., some of or all of the interlocking channels 96).

In the illustrated embodiment of FIG. 4, the first ram 50 includes a set of seal slots 110 formed within portions of the upper blade section 88, the base section 86, and the interlocking arms 70. The seals slots 110 include inner seal surfaces 112 that are laterally recessed (e.g., with respect to the lateral axis 34) within the upper blade section 88, the base section 86, and the interlocking arms 70. Upper seal surfaces 114 extend between the inner seal surfaces 112 and an outer surface 116 of the upper blade section 88. Lower seal surfaces 118 extend between the inner seal surfaces 112 and respective outer surfaces 120 of the interlocking arms 70. The seal slots 110 may be configured to receive one or more seals 122 (e.g., polymeric seals) that may be coupled to the first body portion 80. When the first ram 50 is in an installed configuration within the housing 56 of the BOP 40, the seals 122 may engage an interior surface of the housing 56 to mitigate or substantially eliminate fluid flow (e.g., flow of wellbore fluids) between the housing 56 and an exterior of the first ram 50. In some embodiments, a connecting slot 124 may extend between the seals slots 110 and be configured to receive an additional seal (e.g., a seal of the one or more seals 122) for blocking fluid flow between the housing 56 and the first ram 50.

As discussed in detail below, the seals 122 may be compressed when the first ram 50 engages with the second ram 52, such as when the first and second rams 50, 52 are transitioned to the closed positions 104. Compression of the seals 122 may impart significant loads (e.g., compressive loads) on the interlocking arms 70. Particularly, compression of the seals 122 may generate a set of axial loads 130 that force the interlocking arms 70 in a third direction 132 (e.g., a downward direction) along the axial axis 30 and a set of lateral loads 134 that force the interlocking arms 70 toward one another (e.g., along the lateral axis 34, in respective inward directions). For example, the lateral loads 134 may force a first one of the interlocking arms 70 (e.g., a first interlocking arm 140) in a fourth direction 142 along the lateral axis 34 and may force a second one of the interlocking arms 70 (e.g., a second interlocking arm 144) in a fifth direction 146 along the lateral axis 34. The fourth direction 142 and the fifth direction 146 may be collectively referred to herein as inward directions 150.

In some embodiments, resultant forces generated by the set of axial loads 130 and the set of lateral loads 134, which may also include loads generated during shearing of the tubular 24, may be sufficient to induce deformation of the interlocking arms 70. Accordingly, the interlocking arms 70 include the deflection mitigation features 41 that, as discussed below, are configured to support at least a portion of the axial loads 130 and/or the lateral loads 134. To this end, the deflection mitigation features 41 may ensure that the axial and/or lateral loads 130, 134 imparted on the interlocking arms 70 are unable to induce meaningful deformation of the interlocking arms 70, and thus, may improve the effectiveness of the shearing operations.

Figure 5:
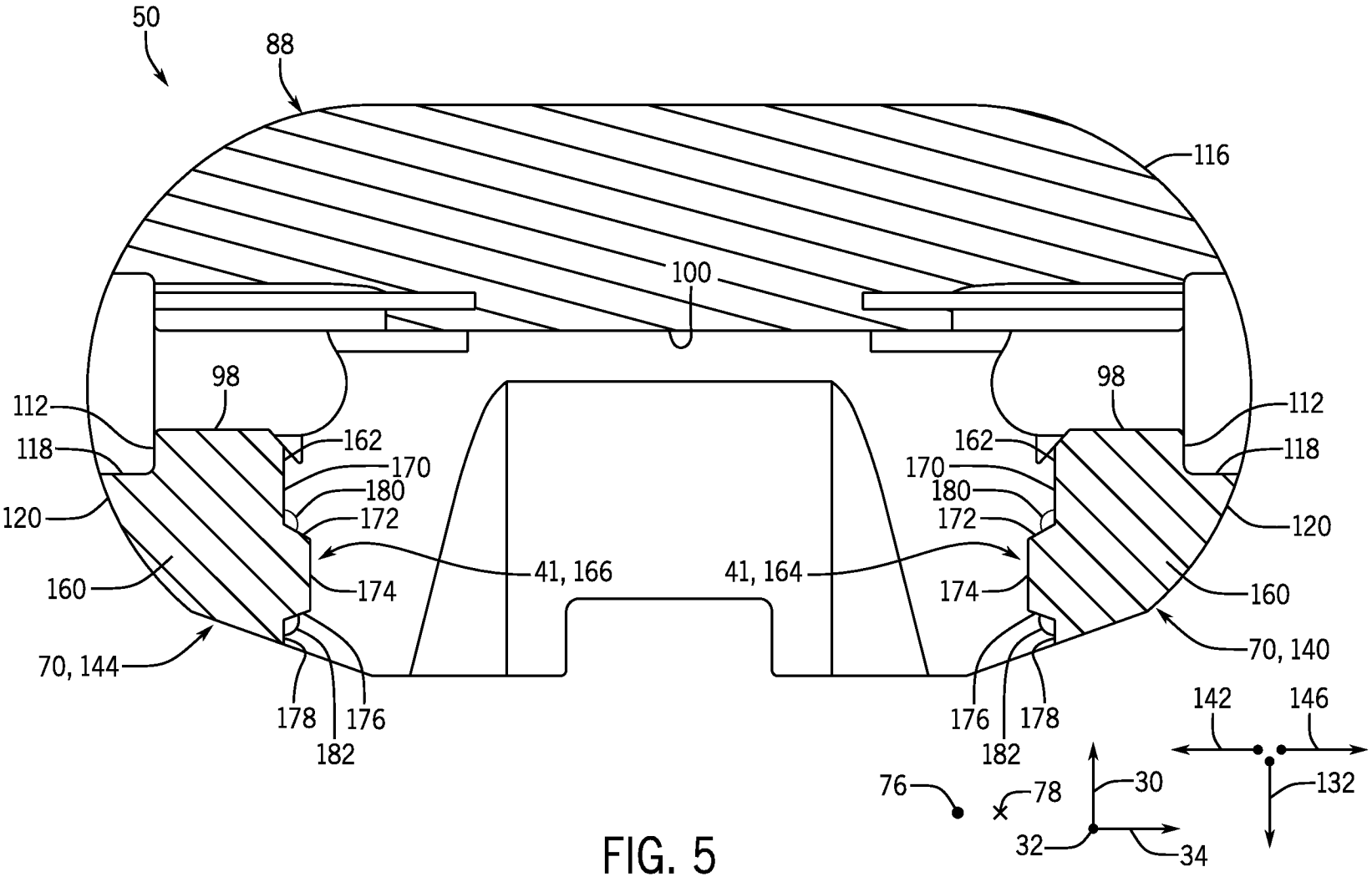
FIG. 5 is a cross-sectional view of the first ram of FIG. 4 taken along line 5-5 of FIG. 4, in accordance with an embodiment of the present disclosure.
Figure 6:
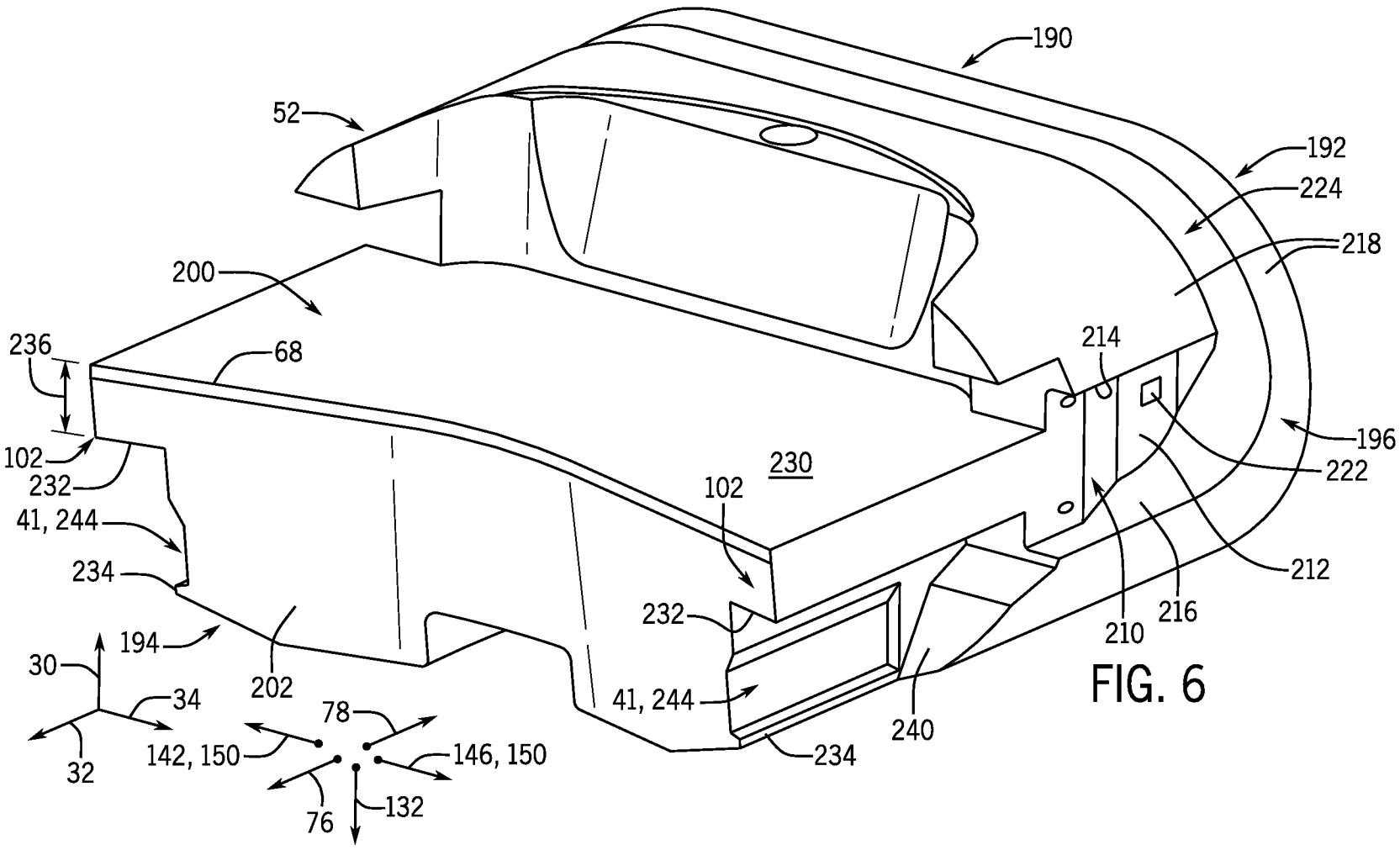
FIG. 6 is a perspective view of the second ram that may be included in the BOP of FIG. 3, in accordance with an embodiment of the present disclosure.

FIG. 5 is a cross-sectional view of an embodiment of the first ram 50 taken along line 5-5 of FIG. 4. The first and second interlocking arms 140, 144 include respective body portions 160 that are bound by the upper surfaces 98, the inner seal surfaces 112, the lower seal surfaces 118, the outer surfaces 120, and respective inner arm surfaces 162 (e.g., laterally inner surfaces) of the interlocking arms 70. In the illustrated embodiment, the first set of deflection mitigation features 41 includes a first protrusion 164 and a second protrusion 166 that are formed in the first interlocking arm 140 and the second interlocking arm 144, respectively. The first protrusion 164 extends laterally-inwardly from the body portion 160 of the first interlocking arm 140 in the fourth direction 142 and forms a portion of the inner arm surface 162 of the first interlocking arm 140. The second protrusion 166 extends laterally-inwardly from the body portion 160 of the second interlocking arm 144 in the fifth direction 146 and forms a portion of the inner arm surface 162 of the second interlocking arm 144. The first and second protrusions 164, 166 extend longitudinally along at least a portion of a length of the first and second interlocking arms 140, 144. For example, the first and second protrusions 164, 166 may extend in the second direction 78 (e.g., along the longitudinal axis 32) along 5 percent, 10 percent, 20 percent, 30 percent, 40 percent, 50 percent, or more than 50 percent of a length of the first and second interlocking arms 140, 144.

The inner arm surfaces 162 of the first and second interlocking arms 140, 144 each include a first portion or surface 170, a second portion or surface 172, a third portion or surface 174, a fourth portion or surface 176, and a fifth portion or surface 178. As shown in the illustrated embodiment of FIG. 5, the second, third, and fourth surfaces 172, 174, 176 may define a profile of the protrusions 164, 166. In some embodiments, the first surfaces 170, the third surfaces 174, and the fifth surfaces 178 may extend generally parallel to one another. In certain embodiments, respective first angles 180 between the first surfaces 170 and the second surfaces 172 may be greater than respective second angles 182 between the fourth surfaces 176 and the fifth surfaces 178.

In other embodiments, the first and second angles 180, 182 may be substantially equal to one another. For example, the first and second angles 180, 182 may each be approximately ninety degrees, such that the second and fourth surfaces 172, 176 extend generally orthogonal or crosswise to the first and fifth surfaces 170, 178. Indeed, it should be understood that the first and second protrusions 164, 166 may include any suitable cross-sectional profiles and are not limited to the cross-sectional profiles shown in the illustrated embodiment of FIG. 5. As a non-limiting example, the first and second protrusions 164, 166 may include quadrilateral cross-sectional profiles, semi-circular cross-sectional profiles, or any other suitable cross-sectional profiles. Moreover, although the protrusions 164, 166 are shown as integrally formed with the interlocking arms 70 in the illustrated embodiment, it should be appreciated that, in other embodiments, the protrusions 164, 166 may include separate components that are coupled to the interlocking arms 70 via suitable fasteners, an interference fit, or a metallurgical process, such as welding or brazing.

Throughout the subsequent discussion, the third surfaces 174 may be referred to as "lateral contact surfaces" of the interlocking arms 70 and the fourth surfaces 176 may be referred to as "vertical contact surfaces" of the interlocking arms 70. The second, third, and fourth surfaces 172, 174, 176 may be collectively referred to as "profiled portions" of the inner arm surfaces 162. The first and fifth surfaces 170, 178 may be collectively referred to as "non-profiled portions" of the inner arm surfaces 162.

FIG. 6 is a perspective view of an embodiment of the second ram 52. As shown in the illustrated embodiment, the second ram 52 includes a second body portion 190 that extends along the longitudinal axis 32 from a first end portion 192 of the second body portion 190 to a second end portion 194 of the second body portion 190. The first end portion 192 of the second body portion 190 includes a base section 196 that may be configured to couple to the corresponding connecting rod 63 of the second ram 52 via fasteners, an interference fit, or another suitable connection or coupler.

A lower blade section 200 protrudes from the base section 196 (e.g., in the first direction 76) and extends generally along the longitudinal axis 32. The blade 68 of the second ram 52 is positioned along an end face 202 of the lower blade section 200. The second ram 52 includes a set of the seal slots 210 that are formed within portions of the lower blade section 200 and base section 196. The seals slots 210 include inner seal surfaces 212 that are laterally recessed (e.g., with respect to the lateral axis 34) within the lower blade section 200 and the base section 196. Upper seal surfaces 214 and lower seal surfaces 216 extend between the inner seal surfaces 212 and an outer surface 218 of the base section 196. The seal slots 110 are configured to receive one or more seals 222 (e.g., polymeric seals) that may be coupled to the second body portion 190. When the second ram 52 is in an installed configuration within the housing 56 of the BOP 40, the seals 222 may engage an interior surface of the housing 56 to mitigate or substantially eliminate fluid flow (e.g., flow of wellbore fluids) between the housing 56 and an exterior of the second ram 52. In some embodiments, a connecting slot 224 may extend between the seal slots 210 and be configured to receive an additional seal (e.g., a seal of the one or more seals 222) for blocking fluid flow between the housing 56 and the second ram 52. As discussed below, the seals 222 of the second ram 52 may be compresses against the seals 122 of the first ram 50 when the first ram 50 translates toward and engages with the second ram 52, such as when the first and second rams 50, 52 are transitioned to the closed positions 104.

As noted above, the second ram 52 includes the interlocking tabs 102, which are configured to engage with (e.g., be received in) the interlocking channels 96 of the first ram 50. In the illustrated embodiment, the interlocking tabs 102 are bound by an upper surface 230 of the lower blade section 200, the inner seal surfaces 212, and respective lower surfaces 232 of the lower blade section 200. The lower surfaces 232 extend from lateral surfaces 234 of the lower blade section 200 to the inner seal surfaces 212. In some embodiments, respective axial thicknesses 236 of the interlocking tabs 102 may be marginally less that a width of the gaps 94 (see, e.g., FIG. 4) of the interlocking channels 96. As such, the interlocking tabs 102 may engage with and translate along the interlocking channels 96 in the first and second directions 76, 78 (e.g., along the longitudinal axis 32), while axial movement of the interlocking tabs 102 relative to the interlocking channels 96 (e.g., along the axial axis 30) is substantially blocked. In some embodiments, the axial thicknesses 236 of the interlocking tabs 102 may be substantially constant along a length of the interlocking tabs 102.

In certain embodiments, the second body portion 190 of the second ram 52 includes a set of receiving surfaces 240 that may be configured to engage (e.g., physically contact) the end faces 92 (see e.g., FIG. 4) of the interlocking arms 70 when the first and second rams 50, 52 are transitioned to the closed positions 104 within the BOP 40. The interlocking arms 70 may be configured to translate along the lateral surfaces 234 and toward the receiving surfaces 240 when the first and second rams 50, 52 converge within the BOP 40.

In the illustrated embodiment, the deflection mitigation features 41 of the second ram 52 include grooves 244 that are recessed within the lower blade section 200 of second ram 52. As such, the grooves 244 form portions of the lateral surfaces 234 of the lower blade section 200. The grooves 244 extend from the end face 202 of the lower blade section 200 and along the longitudinal axis 32, across at least a portion of a longitudinal length of the lower blade section 200. As discussed in detail below, the grooves 244 are configured to engage with corresponding ones of the protrusions 164, 166 formed in the interlocking arms 70 to inhibit or substantially mitigate deflection of the interlocking arms 70 during shearing operations of the BOP 40.

Figure 7:
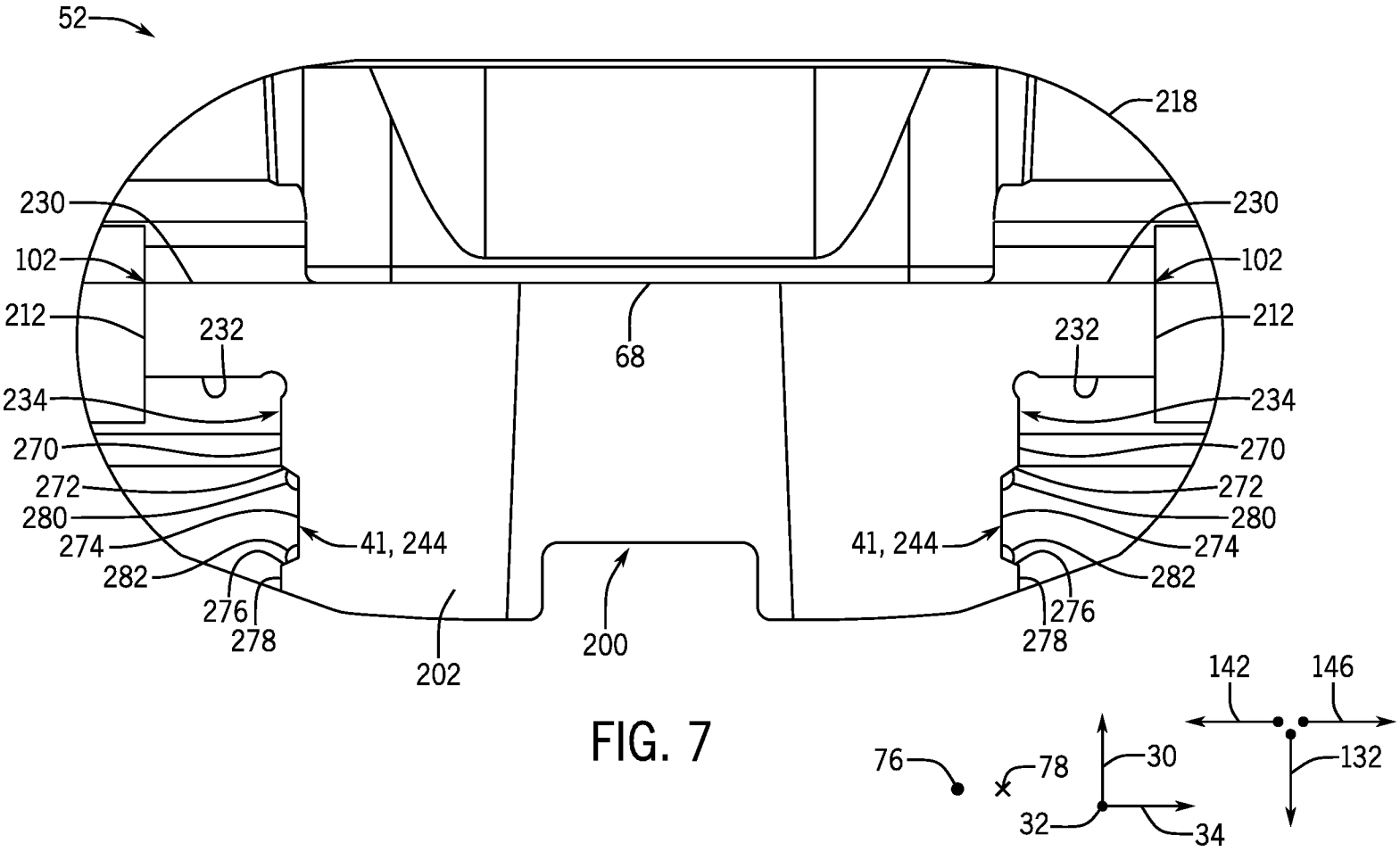
FIG. 7 is a front view of the second ram of FIG. 6, in accordance with an embodiment of the present disclosure.

To better illustrate the grooves 244 and to facilitate the following discussion, FIG. 7 is a front view of an embodiment of the second ram 52. As shown in the illustrated embodiment, the lateral surfaces 234 of the lower blade section 200 each include a first portion or surface 270, a second portion or surface 272, a third portion or surface 274, a fourth portion or surface 276, and a fifth portion or surface 278. The second, third, and fourth surfaces 272, 274, 276 may define respective profiles of the grooves 244. In some embodiments, the first surfaces 270, the third surfaces 274, and the fifth surfaces 278 may extend generally parallel to one another. In certain embodiments, respective first angles 280 between the first surfaces 270 and the second surfaces 272 may be greater than respective second angles 282 between the fourth surfaces 276 and the fifth surfaces 278.

In other embodiments, the first and second angles 280, 282 of the lateral surfaces 234 may be substantially equal to one another. For example, the first and second angles 280, 282 may each be approximately ninety degrees, such that the second and fourth surfaces 272, 276 extend generally orthogonal or crosswise to the first and fifth surfaces 270, 278. Indeed, it should be understood that the grooves 244 may includes any suitable cross-sectional profiles and are not limited to the cross-sectional profiles shown in the illustrated embodiment of FIG. 7. In some embodiments, the cross-sectional profiles of the grooves 244 may be geometrically similar to the cross-sectional profiles of the protrusions 164, 166 (e.g., to facilitate engagement; to form a key-slot interface). In such embodiments, the first angles 180 and the second angles 182 of the inner arm surfaces 162 of the interlocking arms 70 may be substantially equal to the first angles 280 and the second angles 282, respectively, of the lateral surfaces 234 of the lower blade section 200.

Throughout the subsequent discussion, the third surfaces 274 may be referred to as "lateral contact surfaces" of the lower blade section 200 and the fourth surfaces 276 may be referred to as "vertical contact surfaces" of the lower blade section 200. The second, third, and fourth surfaces 272, 274, 276 may be collectively referred to as "profiled portions" of the lateral surfaces 234. The first and fifth surfaces 270, 278 may be collectively referred to as "non-profiled portions" of the lateral surfaces 234.

FIG. 8 is a side view of an embodiment of the first ram 50 and the second ram 52 in an engaged configuration 290, in which the first and second rams 50, 52 are in the closed positions 104. In certain embodiments, when the first and second rams 50, 52 are in the engaged configuration 290, the end faces 92 of the interlocking arms 70 may engage (e.g., physically contact) the receiving surfaces 240 of the second ram 52. Additionally or alternatively, when the first and second rams 50, 52 are in the engaged configuration 290, the end face 90 of the upper blade section 88 of the first ram 50 may engage (e.g., physically contact) a contact surface 292 of the lower blade section 200 of the second ram 52. In other embodiments, gaps may remain between the end faces 92 and the receiving surfaces 240 and/or between the end face 90 and the contact surface 292 when the first and second rams 50, 52 are in the engaged configuration 290.

In any case, in the engaged configuration 290 of the first and second rams 50, 52, the seals 122 of the first ram 50 may be compressed against (e.g., via a force applied by the pistons 62) the seals 222 of the second ram 52. As a result, the seals 122, 222 may apply some of or all of the axial loads 130 and/or the lateral loads 134 on the interlocking arms 70. As noted above, the protrusions 164, 166 and the grooves 244 may be configured to support at least a portion of these loads to mitigate or substantially eliminate deflection of the interlocking arms 70. To this end, the protrusions 164, 166 and the grooves 244 enable the interlocking arms 70 to maintain the blade 68 of the first ram 50 substantially adjacent to the upper surface 230 of the lower blade section 200 and to maintain the blade 68 of the second ram 52 substantially adjacent to the lower surface 100 of the upper blade section 88 when the first and second rams 50, 52 translate toward one another (e.g., along the longitudinal axis 32), such as during shearing of the tubular 24.

Figure 9:
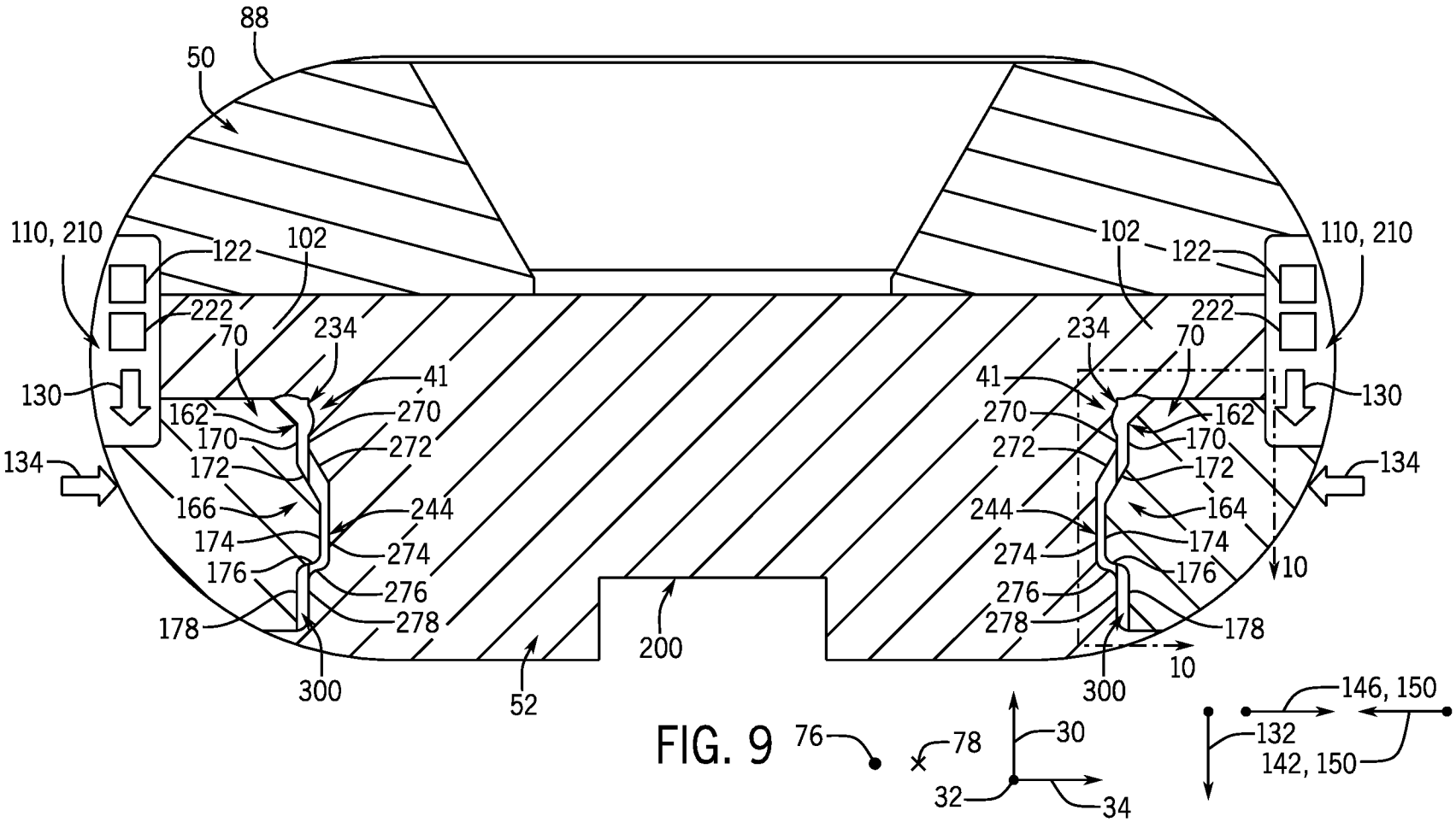
FIG. 9 is a cross-sectional view of the first ram and the second ram of FIG. 8 taken along line 9-9 of FIG. 8, in accordance with an embodiment of the present disclosure.

To better illustrate the engagement of the protrusions 166, 164 and the grooves 244, FIG. 9 is a cross-sectional view of the first and second rams 50, 52 taken along line 9-9 of FIG. 8. As shown in the illustrated embodiment of FIG. 9, the protrusions 164, 166 may be configured to extend into the grooves 244 such that at least a portion of the protrusions 164, 166 laterally overlap (e.g., along the lateral axis 34) with the second surfaces 272 and the fourth surfaces 276. In some embodiments, channels 300 or gaps may extend between the lateral surfaces 234 of the lower blade section 200 and the inner arm surfaces 162 of the interlocking arms 70. The channels 300 enable wellbore fluids and/or particulates (e.g. drilling mud) that may be disposed within the bore 25 to flow along the channels 300 and/or occupy the channels 300 during certain periods, such as during periods of relative movement between the first ram 50 and the second ram 52 (e.g., during shearing of the tubular 24). As such, the interlocking arms 70 may translate along the lower blade section 200 substantially without friction between the wellbore fluids, the inner arm surfaces 162, and the lateral surfaces 234.

As discussed above, in some embodiments, the axial loads 130 and/or the lateral loads 134 generated due to compression of the seals 122, 222 within the seal slots 110, 210 may be sufficient to bend or deform the interlocking arms 70 (e.g., from an initial, unloaded state) during operation of the BOP 40. For example, when a magnitude of the axial loads 130 imposed on the interlocking arms 70 exceeds a threshold value, the axial loads 130 may marginally bend the interlocking arms 70 (e.g., in the third direction 132) until the fourth surfaces 176 of the inner arm surfaces 162 contact the fourth surfaces 276 of the lateral surfaces 234. Once the fourth surfaces 176 of the inner arm surfaces 162 contact the fourth surfaces 276 of the lateral surfaces 234 (e.g., in a loaded state of the interlocking arms 70), the protrusions 164, 166 may transfer any excess axial load 130 imposed on the interlocking arms 70 to the lower blade section 200. The lower blade section 200 is of sufficient thickness to inhibit further deflection of the interlocking arms 70 (e.g., in the third direction 132). To this end, engagement between the protrusions 164, 166 and the grooves 244 may inhibit deflection of the interlocking arms 70 beyond a permitted threshold axial dimension (e.g., along the axial axis 30).

As discussed below, dimensions of the channels 300 between the fourth surfaces 176 and the fourth surfaces 276 may be relatively small, such that the amount of interlocking arm deflection permitted by the protrusions 164, 166 and the grooves 244 along the axial axis 30 is substantially negligible. As such, any marginal axial deflection of the interlocking arms 70 (e.g., along the axial axis 30, in the third direction 132) that may occur until the protrusions 164, 166 contact the fourth surfaces 276 (e.g., when the interlocking arms 70 are in a loaded state) insignificantly affects operation of the BOP 40. For example, the amount of interlocking arm deflection permitted by the deflection mitigation features 41 may be within an elastically deformable range of the interlocking arms 70, such that the interlocking arms 70 may revert to their initial configuration upon removal of the axial loads 130.

In other embodiments, the grooves 244 may be formed and/or positioned in the lower blade section 200 such that no gap extends between the fourth surfaces 176 of the inner arm surfaces 162 and the fourth surfaces 276 of the lateral surfaces 234 when the first and second rams 50, 52 are in the engaged configuration 290. Accordingly, in such embodiments, substantially all of the axial loads 130 imposed on the interlocking arms 70 is directly transferred from the interlocking arms 70 to the lower blade section 200, prior to deflection of interlocking arms 70 in the third direction 132. That is, the interlocking arms 70 need not marginally deflect to close the gap between the fourth surfaces 176, 276 before engaging with the lower blade section 200.

Similarly, when a magnitude of the lateral loads 134 on the interlocking arms 70 exceeds a threshold value, the lateral loads 134 may marginally bend the interlocking arms 70 (e.g., in the respective inward directions 150) until the third surfaces 174 of the inner arm surfaces 162 contact the third surfaces 274 of the lateral surfaces 234. Once the third surfaces 174 of the inner arm surfaces 162 contact the third surfaces 274 of the lateral surfaces 234, the protrusions 164, 166 may transfer any excess lateral load 134 imposed on the interlocking arms 70 to the lower blade section 200. The lower blade section 200 is of sufficient thickness to inhibit further deflection of the interlocking arms 70 in the respective inward directions 150. To this end, engagement between the protrusions 164, 166 and the grooves 244 may inhibit deflection of the interlocking arms 70 beyond a permitted threshold lateral dimension.

As discussed below, dimensions of the channels 300 between the third surfaces 174 of the inner arm surfaces 162 and the third surfaces 274 of the lateral surfaces 234 may be relatively small, such that the amount of interlocking arm deflection permitted by the protrusions 164, 166 and the grooves 244 (e.g., along the lateral axis 34) is substantially negligible. As such, any marginal lateral deflection of the interlocking arms 70 (e.g., along the lateral axis 34, in the respective inward directions 150) that may occur until the protrusions 164, 166 contact the third surfaces 274 insignificantly affects operation of the BOP 40. For example, as noted above, the amount of interlocking arm deflection permitted by the deflection mitigation features 41 may be within an elastically deformable range of the interlocking arms 70, such that the interlocking arms 70 may revert to their initial configuration upon removal of the lateral loads 134.

In other embodiments, the grooves 244 may be formed and/or positioned in the lower blade section 200 such that no gaps extend between the third surfaces 174, 274 when the first and second rams 50, 52 are in the engaged configuration 290. Accordingly, in such embodiments, substantially all of the lateral loads 134 imposed upon the interlocking arms 70 are directly transferred from the interlocking arms 70 to the lower blade section 200, prior to deflection of interlocking arms 70 in the respective inward directions 150. That is, the interlocking arms 70 need not marginally deflect (e.g., in the inward directions 150) to close the gaps between the third surfaces 174, 274 before engaging with the lower blade section 200.

Figure 10:
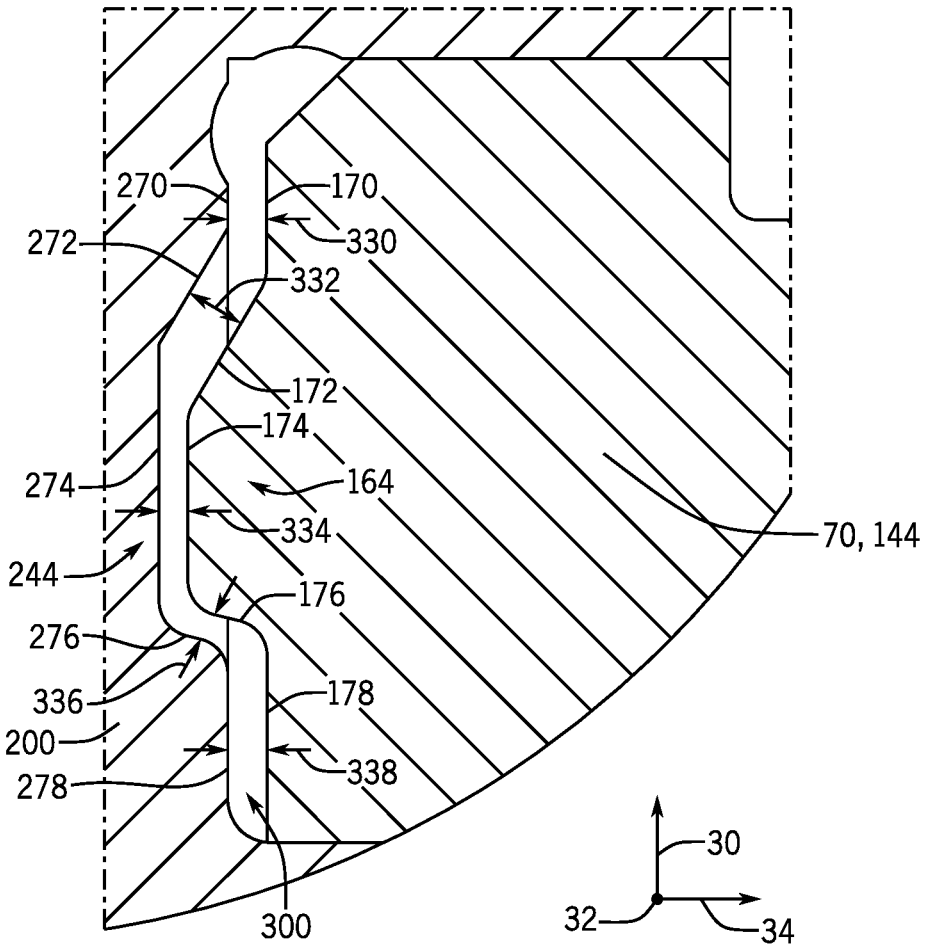
FIG. 10 is an expanded cross-sectional view of the first ram and the second ram of FIG. 8 taken along line 10-10 of FIG. 9, in accordance with an embodiment of the present disclosure.

FIG. 10 is an expanded view of the first and second rams 50, 52 taken along line 10-10 of FIG. 9, which illustrates the channel 300 extending between the first interlocking arm 140 and the lower blade section 200. Although the following discussion is directed toward the channel 300 (e.g., a first channel 300) extending between the first interlocking arm 140 and the lower blade section 200, it should be understood that the channel 300 extending between the second interlocking arm 144 and the lower blade section 200 may include some of or all of the features of the first channel 300 discussed herein.

In some embodiments, the first, second, third, fourth, and fifth surfaces 170, 172, 174, 176, 178 may extend generally parallel along the first, second, third, fourth, and fifth surfaces 270, 272, 274, 276, 278, respectively. As shown in the illustrate embodiment, the channel 300 may be formed by a first gap 330 extending between the first surfaces 170, 270, a second gap 332 extending between the second surfaces 172, 272, a third gap 334 extending between the third surfaces 174, 274, a fourth gap 336 extending between the fourth surfaces 176, 276, and a fifth gap 338 extending between the fifth surfaces 178, 278. In some embodiments, dimensions of the third and fourth gaps 334, 336 may be less than respective dimensions of the first, second, and/or fifth gaps 330, 332, 338.

For example, dimensions of the third and fourth gaps 334, 336 may be 10 percent, 20 percent, 30 percent, 40 percent, 50 percent, or more than 50 percent less than respective dimensions of the first, second, and/or fifth gaps 330, 332, 338. In this manner, the third and fourth gaps 334, 336 may substantially mitigate deflection of the first interlocking arm 140 in accordance with the techniques discussed above, while blocking direct, physical contact between the first surfaces 170, 270, the second surfaces 172, 272, and the fifth surfaces 178, 278, respectively. For example, because a dimension of the third gap 334 is less than dimensions of the first, second, and fifth gaps 330, 332, 338, respective gaps may remain between the first, second, and fifth surfaces 170, 172, 178, 270, 272, 278 even when the third surface 174 engages the third surface 274. By enabling a gap to remain between the first, second, and fifth surfaces 170, 172, 178, 270, 272, 278 even when the third surfaces 174, 274 contact one another, frictional forces due to translational movement between the first interlocking arm 140 and the lower blade section 200 may be reduced. It should be understood that, in other embodiments, dimensions of the first, second, third, fourth, and fifth gaps 330, 332, 334, 336, 338 may be substantially equal.

Figure 11:
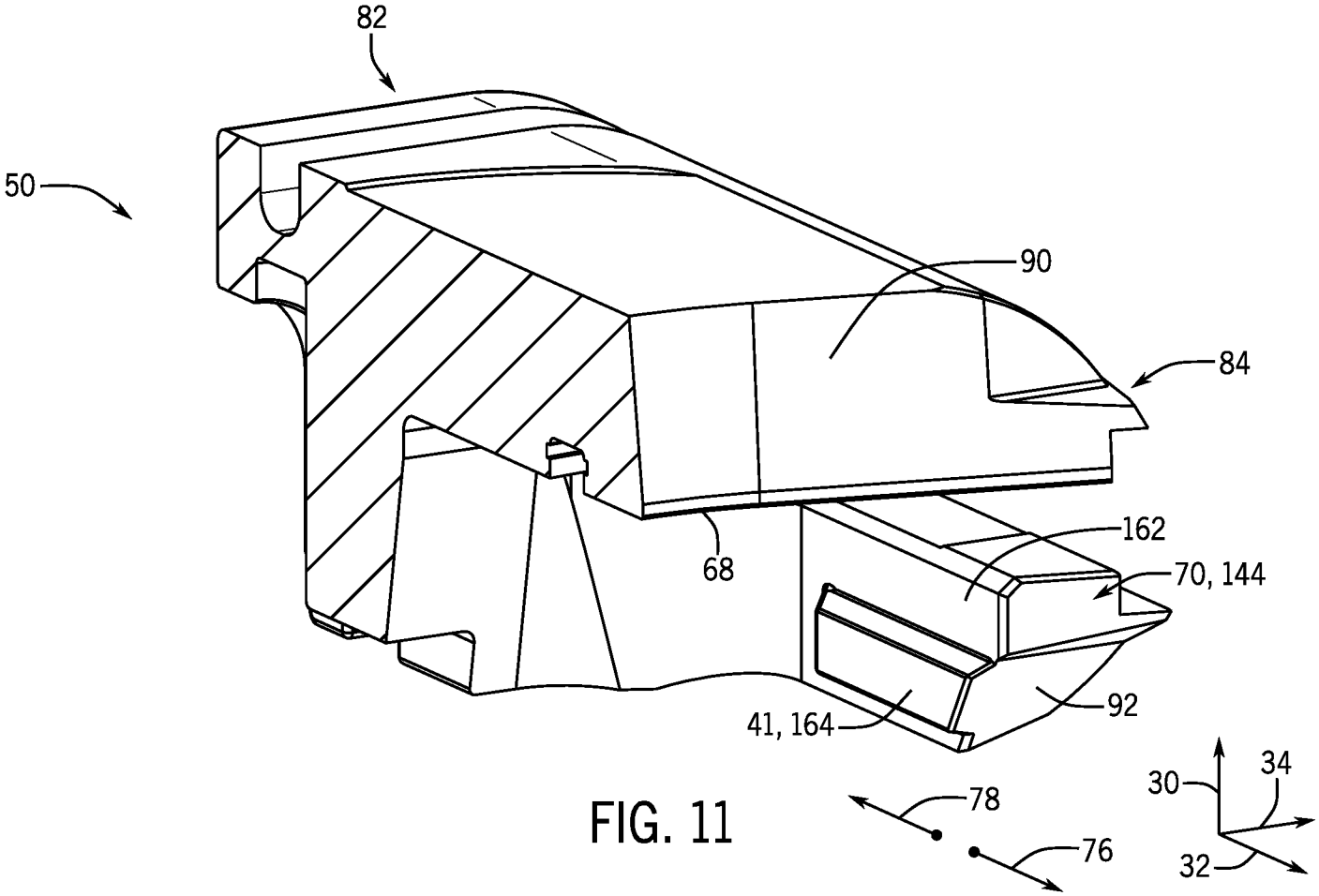
FIG. 11 is a perspective view of the first ram that may be included in the BOP of FIG. 3, in accordance with an embodiment of the present disclosure.

FIG. 11 is a perspective view of an embodiment of a portion of the first ram 50, illustrating the first interlocking arm 144 and its corresponding protrusion 164. In the illustrated embodiment, the protrusion 164 extends from the end face 92 of the first interlocking arm 144 and along the first interlocking arm 144 in the second direction 78. As such, the protrusion 164 may form a portion of the end face 92 of the first interlocking arm 140. In other embodiments, the protrusion 164 may be recessed from the end face 92 (e.g., along the longitudinal axis 32), such that a longitudinal gap 350 (as shown in FIG. 4) extends between the end face 92 and the protrusions 164, 166.

Although the interlocking arms 70 have been described as each having a single protrusion 164 or 166 that is configured to engage with a corresponding groove 244 formed in the lower blade section 200, it should be appreciated that, in other embodiments, the interlocking arms 70 may each include a plurality of protrusions configured to engage with corresponding grooves formed in the lower blade section 200. For example, each of the interlocking arms 70 may include 1, 2, 3, 4, 5, or more than 5 protrusions configured to engage with corresponding grooves formed in the lower blade section 200. Moreover, it should be understood that, in certain embodiments, the protrusions 164, 166 on the interlocking arms 70 may be replaced with grooves and the grooves 244 on the lower blade section 200 may be replaced with corresponding protrusions. In such cases, the grooves on the interlocking arms 70 may have any of the features of the grooves 244 disclosed herein, and the lower blade section 200 may have any of the features of the protrusions 164, 166 disclosed herein. Further, the interlocking arms 70 may each include a series of protrusions and grooves configured to engage with a corresponding series of grooves and protrusions formed in the lower blade section 200.

As set forth above, embodiments of the present disclosure may provide one or more technical effects useful for reducing or substantially inhibiting deflection of interlocking arms of rams of a BOP. In particular, the disclosed anti-deflection features for the rams are configured to block deflection of the interlocking arms of the rams beyond an acceptable range (e.g., a threshold range, such as 1 centimeter) or to substantially inhibit deflection of the interlocking arms. As such, the anti-deflection features may enhance an operational efficiency of the rams and increase an operational reliability of the BOP rams. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A ram system for a blowout preventer, the ram system comprising:

a first ram comprising: a base section; an upper blade section, a plurality of interlocking arms extending along the upper blade section and forming interlocking channels between the upper blade section and the plurality of interlocking arms, and a first set of anti-deflection features formed in the plurality of interlocking arms, wherein the upper blade section and the plurality of interlocking arms protrude from the base section in a first direction, and extend along a longitudinal axis, and wherein an end face of the upper blade section and a respective end face of the plurality of interlocking arms at least partially form an end portion of the first ram; and a second ram comprising a lower blade section, a plurality of interlocking tabs extending from the lower blade section, and a second set of anti-deflection features formed within the lower blade section, the second set of anti-deflection features extending from an end face of the lower blade section and along the longitudinal axis, wherein the plurality of interlocking tabs is configured to extend into and translate along the interlocking channels to enable the first set of anti-deflection features to engage with the second set of anti-deflection features.

2. The ram system of claim 1, wherein the first set of anti-deflection features comprises protrusions extending from the plurality of interlocking arms, and the second set of deflection features comprises grooves formed within the lower blade section.

3. The ram system of claim 2, wherein respective cross-sectional profiles of the protrusions correspond geometrically to respective cross-sectional profiles of the grooves.

4. The ram system of claim 1, wherein, upon application of a load on the plurality of interlocking arms, the first set of anti-deflection features is configured to contact the second set of anti-deflection features to transfer at least a portion of the load from the plurality of interlocking arms to the lower blade section.

5. A ram system for a blowout preventer, the ram system comprising:

a first ram of a pair of rams, wherein the first ram comprises: a base section; an upper blade section; an interlocking arm; and a first anti-deflection feature for the interlocking arm, wherein the upper blade section and the interlocking arm protrude from the base section in a first direction, and extend along a longitudinal axis, and wherein an end face of the upper blade section and a respective end face of the interlocking arm at least partially form an end portion of the first ram; and a second ram of the pair of rams, wherein the second ram comprises: a receiving feature; a lower blade section; and a second anti-deflection feature formed within the lower blade section, the second anti-deflection feature extending from an end face of the lower blade section and along the longitudinal axis, wherein the first ram and the second ram are configured to move toward one another along the longitudinal axis to reach an engaged configuration, wherein, in the engaged configuration, the receiving feature of the second ram receives the interlocking arm of the first ram, and the first anti-deflection feature engages with the second anti-deflection feature to block deflection of the interlocking arm relative to a lateral axis, an axial axis, or both, and wherein the ram system further comprises: an interlocking channel formed between the upper blade section and the interlocking arm, wherein the second ram further comprises an interlocking tab extending from the lower blade section, and wherein the interlocking channel is configured to engage with the interlocking tab while the first ram and the second ram are in the engaged configuration.

6. The ram system of claim 5, wherein the first anti-deflection feature comprises a laterally-extending protrusion extending from a first body of the interlocking arm, and the second anti-deflection feature comprises a laterally-recessed groove formed within a second body of the second ram.

7. The ram system of claim 6, wherein a gap extends between the laterally-extending protrusion and the laterally-recessed groove in an unloaded state of the interlocking arm, and the laterally-extending protrusion is configured to contact a surface of the laterally-recessed groove to enable force transfer between the laterally-extending protrusion and the second body of the second ram in a loaded state of the interlocking arm.

8. The ram system of claim 5, wherein the first anti-deflection feature extends along the longitudinal axis and along at least a portion of a length of the interlocking arm.

9. The ram system of claim 5, wherein the interlocking arm comprises a laterally-inner surface comprising a first profiled portion and a first non-profiled portion, wherein the first anti-deflection feature extends along the first profiled portion, and wherein the first anti-deflection feature comprises a first lateral contact surface and a first vertical contact surface.

10. The ram system of claim 9, wherein the lower blade section of the second ram comprises a laterally-outer surface comprising a second profiled portion and a second non-profiled portion, wherein the second anti-deflection feature extends along the second profiled portion, and wherein the second anti-deflection feature comprises a second lateral contact surface and a second vertical contact surface.

11. The ram system of claim 10, wherein, while the first ram and the second ram are in the engaged configuration, a first gap extends between the first lateral contact surface and the second lateral contact surface, a second gap extends between the first vertical contact surface and the second vertical contact surface, and a third gap extends between the first non-profiled portion and the second non-profiled portion, and dimensions of the first and second gaps are less than a dimension of the third gap.

12. The ram system of claim 5, wherein the first ram and the second ram are shear rams.

13. A blowout preventer (BOP) system, comprising:

a housing defining a bore;

a first ram positioned within the housing, the first ram comprising: a base section;

an upper blade section; an interlocking arm; and a first anti-deflection feature for the interlocking arm, wherein the upper blade section and the interlocking arm protrude from the base section in a first direction, and extend along a longitudinal axis, and wherein an end face of the upper blade section and a respective end face of the interlocking arm at least partially form an end portion of the first ram; and a second ram positioned within the housing and configured to mate with the first ram in an engaged configuration to form a seal across the bore, wherein the second ram comprises: a body portion comprising a second anti-deflection feature; and a lower blade section, wherein the second anti-deflection feature is formed within the lower blade section, the second anti-deflection feature extending from an end face of the lower blade section and along the longitudinal axis, wherein the first anti-deflection feature is configured to engage with the second anti-deflection feature while the first ram and the second ram are in the engaged configuration to thereby block deflection of the interlocking arm relative to the second ram, wherein the first anti-deflection feature is formed on a laterally-inner surface of the interlocking arm, the second anti-deflection feature is formed on a laterally-outer surface of the body portion, and a channel extends between the laterally-inner surface of the interlocking arm and the laterally-outer surface of the body portion while the first ram and the second ram are in the engaged configuration, and wherein a first dimension of the channel along a lateral contact surface of the first anti-deflection feature, a second dimension of the channel along a vertical contact surface of the first anti-deflection feature, or both, is less than a third dimension of the channel along a remaining portion of the laterally-inner surface.

14. The BOP system of claim 13, wherein the first anti-deflection feature comprises a protrusion formed on a laterally-inner surface of the interlocking arm, and the second anti-deflection feature comprises a groove formed on a laterally-outer surface of the body portion of the second ram.

15. The BOP system of claim 13, comprising actuators configured to transition the first ram and the second ram from respective default positions in which the first ram and the second ram do not form the seal across the bore to the engaged configuration.

16. The BOP system of claim 15, comprising a first seal coupled to the first ram and a second seal coupled to the second ram, wherein the actuators are configured to compress the first seal against the second seal to place the first seal and the second seal in a compressed configuration as the actuators transition the first ram and the second ram to the engaged configuration, the first seal and the second seal are configured to impart a force on the interlocking arm while the first seal and the second seal are in the compressed configuration, and the first anti-deflection feature is configured to transfer at least a portion of the force to the second ram via engagement with the second anti-deflection feature.

* * * * *